US006702304B2

(12) United States Patent
Chu

(10) Patent No.: US 6,702,304 B2
(45) Date of Patent: Mar. 9, 2004

(54) DETACHABLE SKATE

(76) Inventor: Wei-Yen Chu, No. 261, Ta Chu Road, Lu Chu Hsiang, Taoyuan Hsien (TW)

( * ) Notice: Subject to any disclaimer, the term of this patent is extended or adjusted under 35 U.S.C. 154(b) by 37 days.

(21) Appl. No.: 10/051,132

(22) Filed: Jan. 22, 2002

(65) Prior Publication Data

US 2003/0137115 A1 Jul. 24, 2003

(51) Int. Cl.[7] ..... A63C 1/04; A63C 17/00; A63C 1/00; A43B 23/28

(52) U.S. Cl. ..... 280/11.33; 280/11.19; 280/11.12; 36/58.5

(58) Field of Search ..... 280/11.19, 11.3, 280/11.31, 11.32, 11.33, 11.12; 36/58.5, 58.6

(56) References Cited

U.S. PATENT DOCUMENTS 779,417 A * 1/1905 Finkle ..... 280/11.3
2,244,719 A * 6/1941 Mansfield ..... 280/11.3
3,918,729 A * 11/1975 Peters ..... 280/11.3
6,120,038 A * 9/2000 Dong et al. ..... 280/7.13
6,270,089 B1 * 8/2001 Marechal ..... 280/11.3
6,334,621 B1 * 1/2002 Chang ..... 280/11.3
6,382,638 B1 * 5/2002 Lee ..... 280/7.13

* cited by examiner

*Primary Examiner*—Brian L. Johnson
*Assistant Examiner*—Gerald Klebe
(74) *Attorney, Agent, or Firm*—Rosenberg, Klein & Lee

(57) ABSTRACT

A detachable skate having two sets of engagement members containing two female members and two male members which are correspondingly fitted to a sole at the bottom of the shoe and a mounting plate at the top of the skating device. The female members and the male members can be connected with each other by means of the engagement of a projecting pin into the bottom end of the vertical part of the L-shaped guide slot. Moreover, one male member is provided with a lever for turning this male member. Accordingly, the shoes are detachable from the skating devices so that it's convenient to assemble, stable and safe to use.

7 Claims, 11 Drawing Sheets

DETACHABLE SKATE

BACKGROUND OF THE INVENTION

1. Field of the Invention

The present invention relates to a detachable skate, and more particularly to a skate whose shoe can be detached from the skating device for walking.

2. Description of the Prior Art

The shoe and the skating device of conventional roller skates, ice skates and in-line skates are all integrated in a body so that they have a large volume and are not easy to carry. Moreover, they are useless except the skating exercise. When either the shoe or the skating device is defective or malfunctioning, the whole body becomes a discard. Furthermore, their defective or malfunctioning parts is not repairable. This is another drawback of the conventional skates. In order to improve the conventional skates in an integrated form, Taiwan Pat. No. 447319 "detachable in-line skate" discloses a detachable structure of the shoe and the skating device (see FIGS. 11 through 13). In this disclosure, the shoe 11 is connected only with the front end of the skating device 12 by a safety pin 10 while the rear end of thereof has no safety arrangement. Thus, the fixing force between the shoe 11 and the skating device 12 only by means of a safety pin 10 is insufficient and it only focuses at the front side. Consequently, both parts of this in-line skate are easily taken apart.

In addition, another Taiwan Pat. Nos. 338338, 182154 and 205169 also teach a detachable design of the shoe and the skating device, having their own features. However, they still have drawbacks for improvement. Their technologies are much different from the present invention so that no further descriptions are given hereinafter.

SUMMARY OF THE INVENTION

It is a primary object of the present invention to provide a detachable skate having two sets of engagement members containing two female members and two male members which are correspondingly fitted to a sole at the bottom of the shoe and a mounting plate at the top of the skating device. In addition, the shoes are detachable from the skating devices so that it's convenient to assemble, stable and safe to use.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
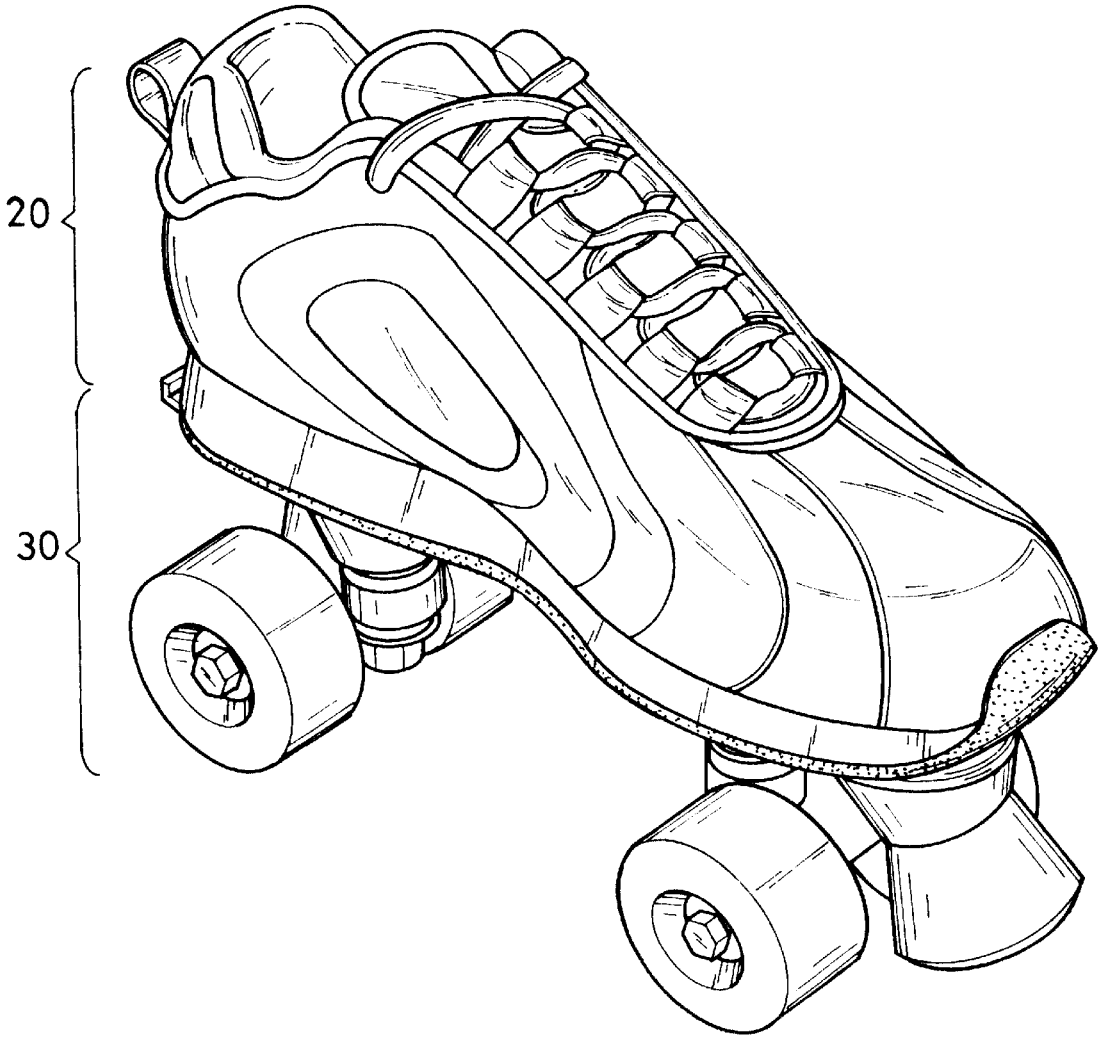
FIG. 1 is a perspective view of the present invention.
Figure 2:
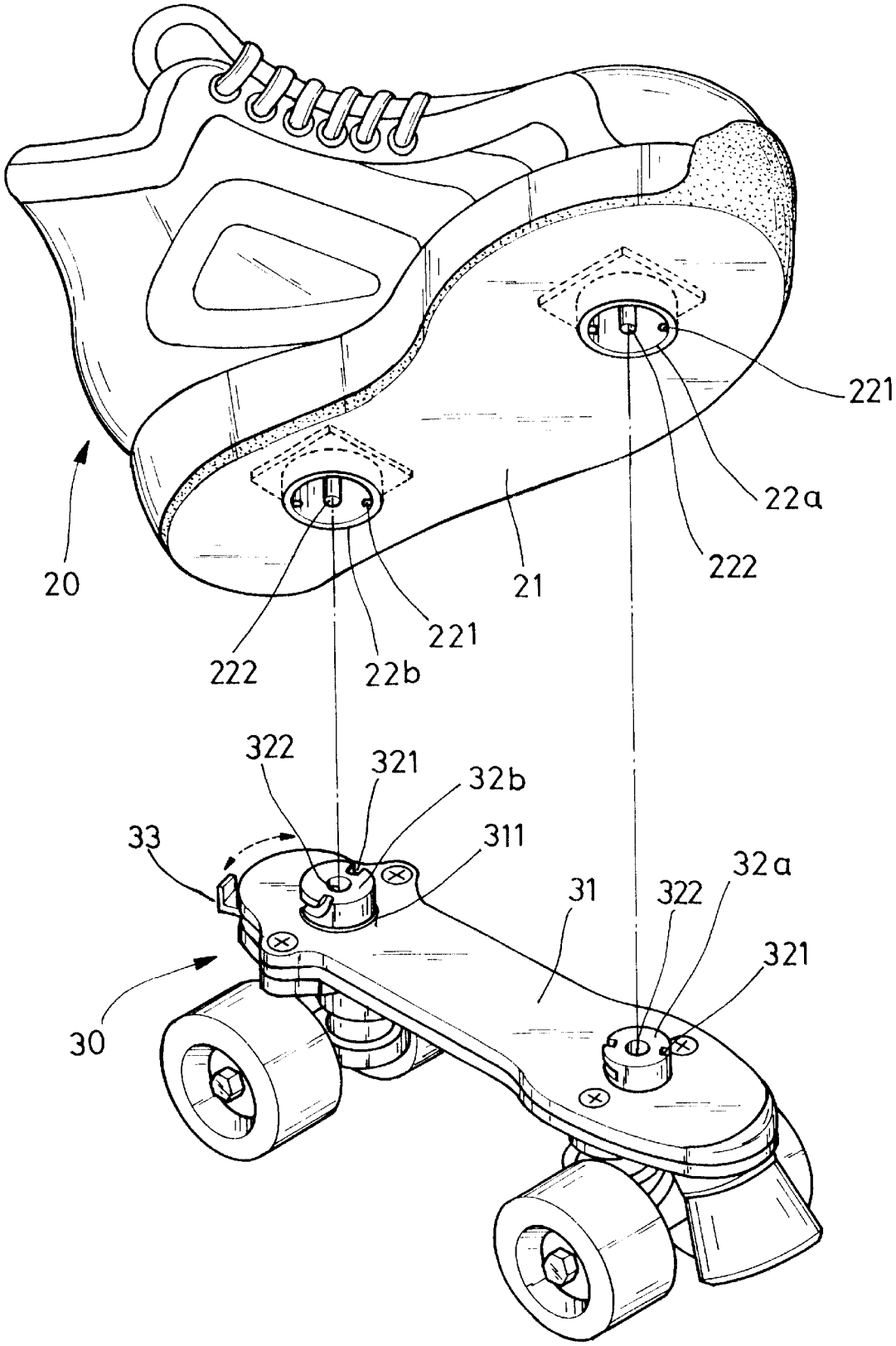
FIG. 2 is a perspective exploded view of the present invention.

First of all, referring to FIGS. 1 through 5, the present invention primarily includes a shoe 20 and a skating device 30.

Two sets of engagement members consist of two female members 22*a*, 22*b* and two male members 32*a*, 32*b* correspondingly fitted to a sole 21 at the bottom of the shoe 20 and a mounting plate 31 at the top of the skating device 30.

The female members 22*a*, 22*b* are constructed as a socket with an opening downward. At least one projecting pin 221 is radially mounted on the internal wall of each of the female members 22*a*, 22*b*. Besides, a vertical guide post 222 is disposed in the middle of the female members 22*a*, 22*b*.

The male members 32*a*, 32*b* can be fitted into the female members 22*a*, 22*b*. An L-shaped guide slot 321 corresponding to the projecting pin 221 is formed at the outer side of the male members 32*a*, 32*b*. In addition, the male member 32*b* is provided with a lever 33 through which the male member 32*b* can be turned on the guide post 222 at a certain angle. Moreover, the male members 32*a*, 32*b* have a guide hole 322 in the middle thereof corresponding to the guide post 222 of the female members 22*a*, 22*b*.

Therefore, the female members 22*a*, 22*b* and the male members 32*a*, 32*b* can be connected with each other by means of the engagement of the projecting pin 221 into the bottom end of the vertical part of the L-shaped guide slot 321, whereupon the projecting pin 221 is turned to the front end of the horizontal part thereof. Accordingly, the female members 22*a*, 22*b* and the male members 32*a*, 32*b* are secured to each other while the shoe 20 and the skating device 30 are stably fixed together.

The guide post 222 of the female members 22*a*, 22*b* and the guide hole 322 of the male members 32*a*, 32*b* are used for alignment in place during in the engagement operation.

Figure 3:
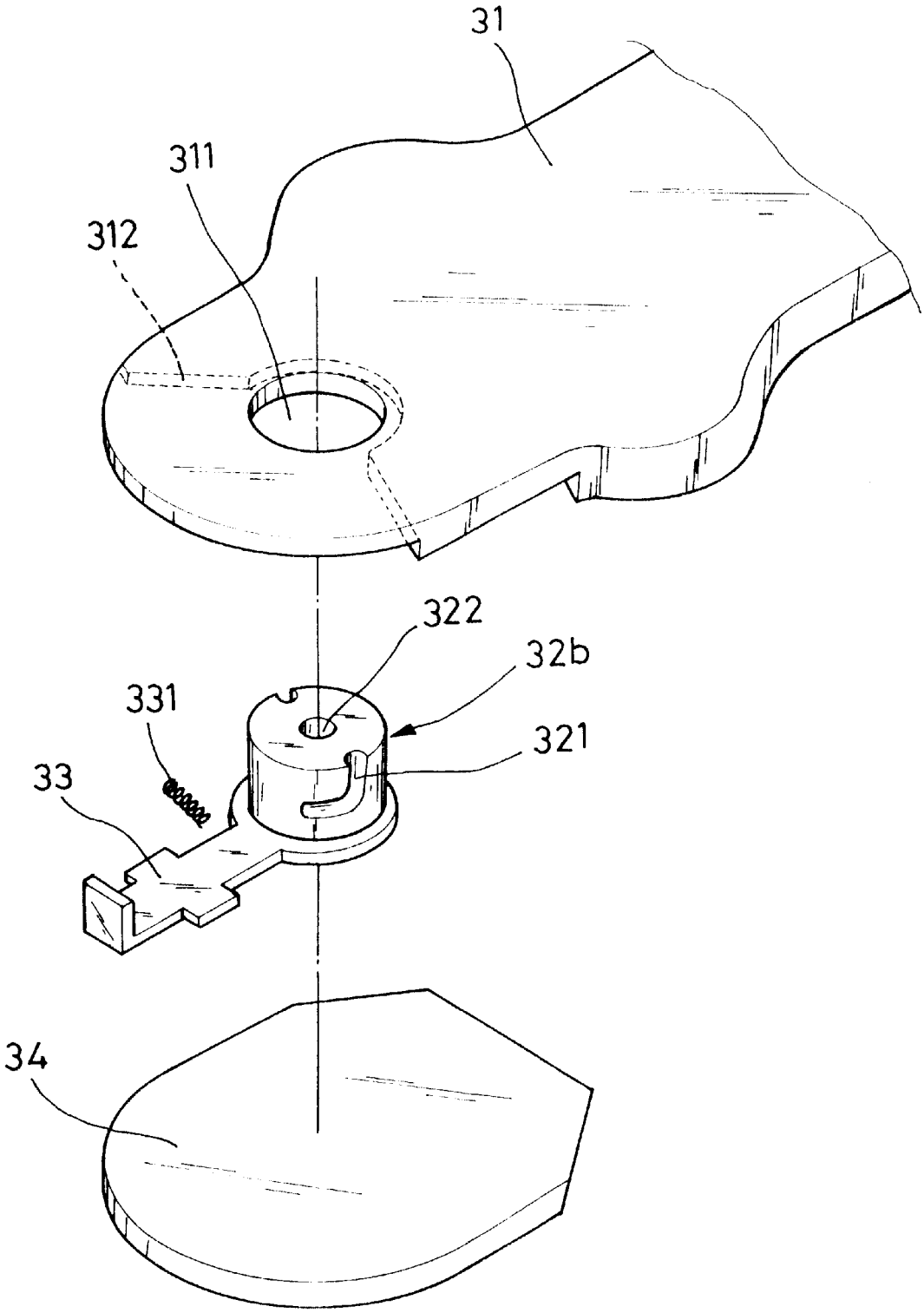
FIG. 3 is a perspective exploded view of an engaging element of the present invention.

An applicable embodiment of the mounting way of the male members 32*b* is illustrated in FIG. 3. The mounting plate 31 is provided with a round through hole 311 from which the male members 32*b* is able to project upwards. The lever 33 is fitted to a groove 312 at the bottom of the mounting plate 31 so that the lever 33 is rotatable to certain extent. Besides, a fixing plate 34 is fitted to the bottom of the mounting plate 31 for sealing the bottom of the groove 312. Accordingly, the male member 32*b* is pivotably connected to the mounting plate 31.

In order to fix the lever 33 in place, the lever 33 is provided with a resilient element 331 to keep the male members 32*b* in a locked state. The resilient element 331 can be a compression spring or a leaf spring. It's aimed that the male member 32*b* doesn't move during exercise. It's found from the experiments that the male member 32*b* won't be loosened when the female member 22*b* and the male member 32*b* are secured together only if the projecting pin 221 and the L-shaped guide slot 321 are correctly engaged. So, the safety can be certainly enhanced with the resilient element 331.

Figure 4:
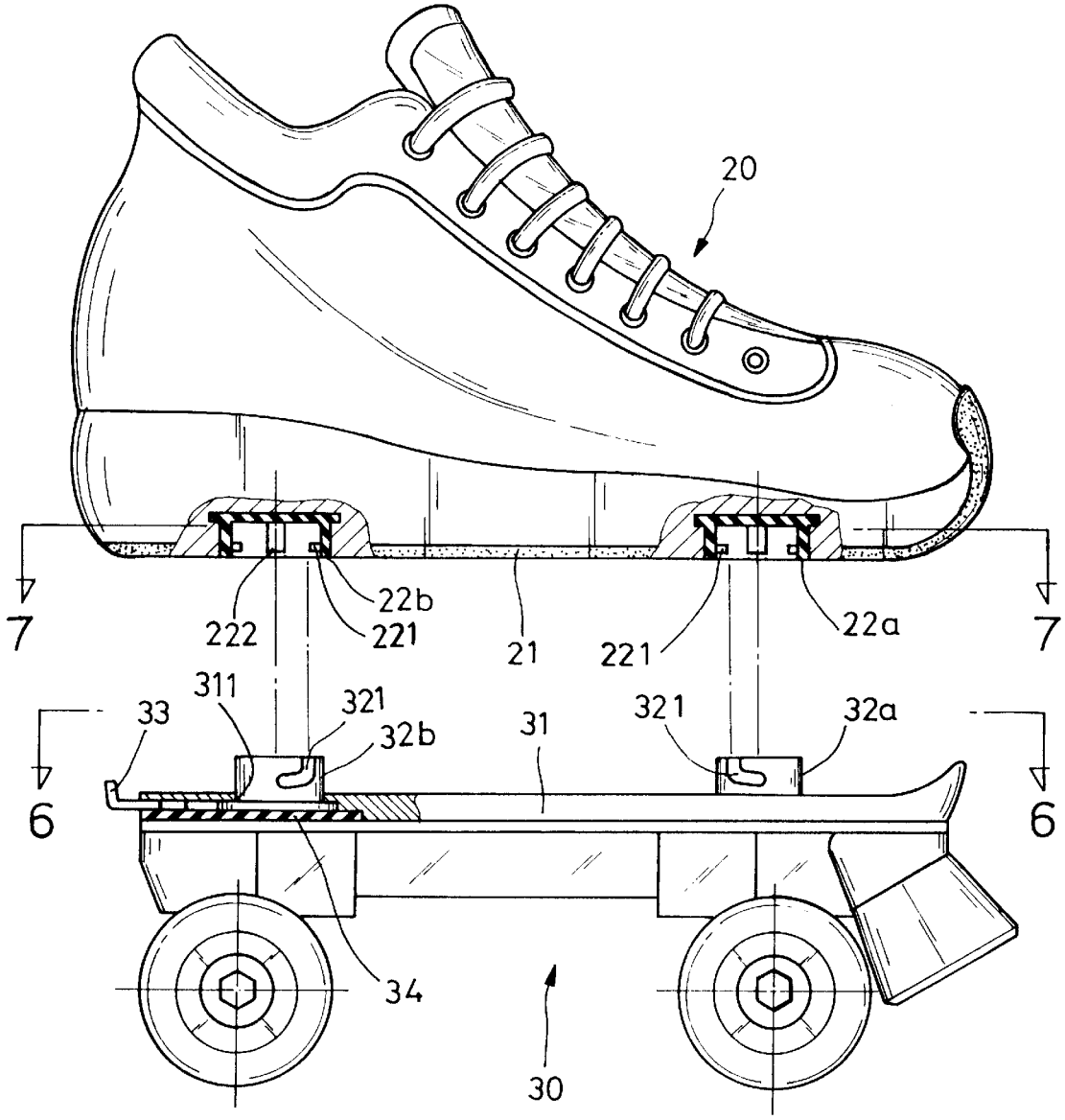
FIG. 4 is an exploded side view of the present invention.
Figure 5:
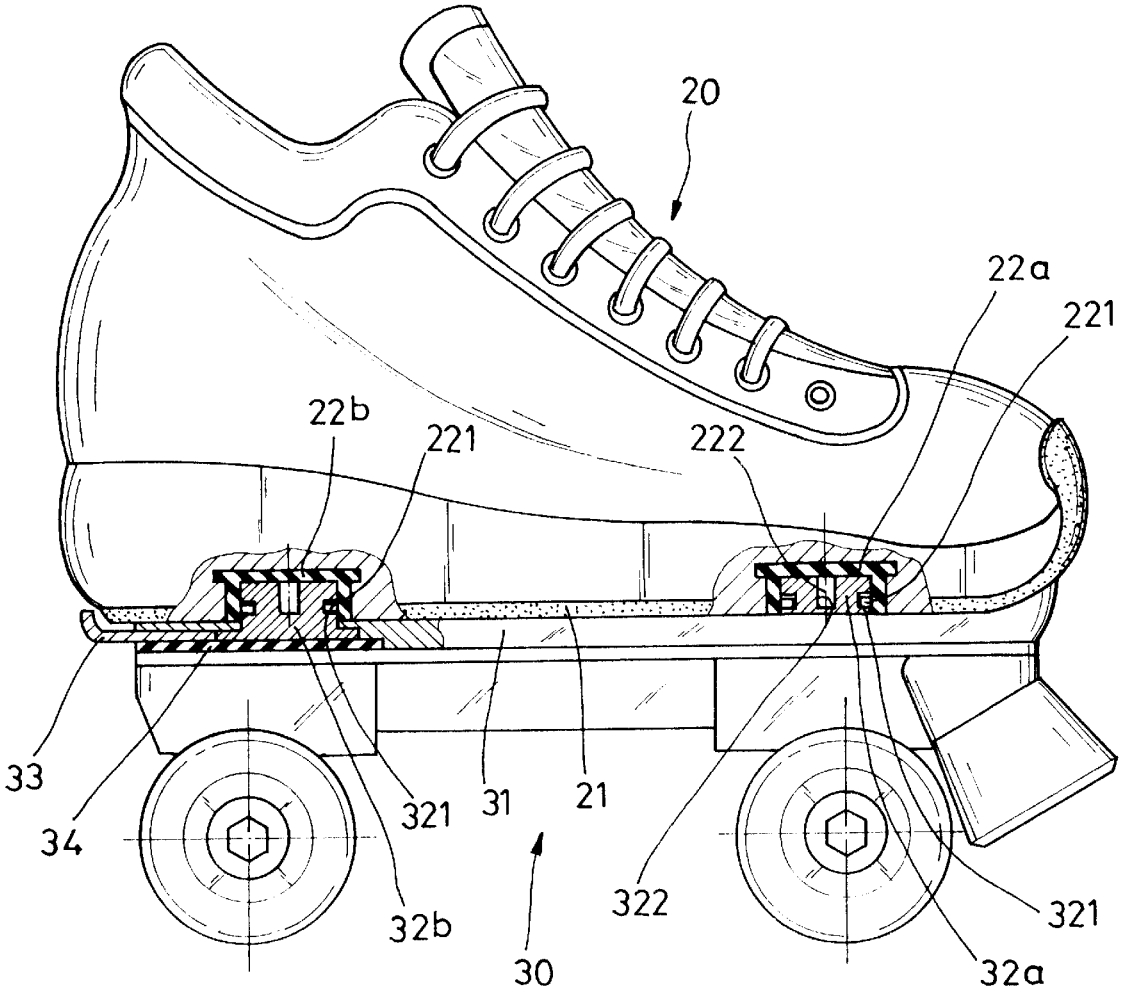
FIG. 5 is a side view of the present invention after assembly.
Figure 6:
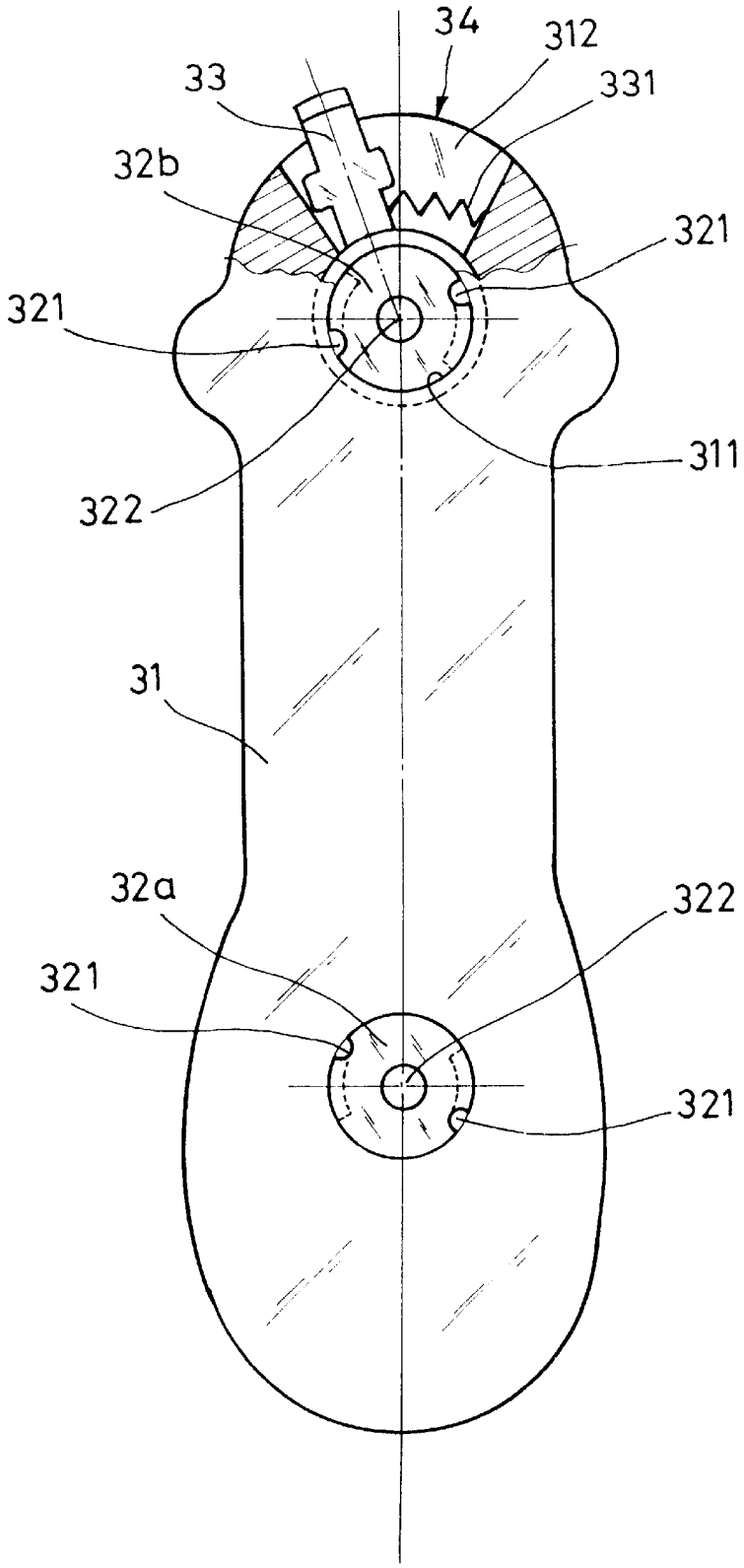
FIG. 6 is a schematic drawing in the direction 6—6 of FIG. 4.
Figure 7:
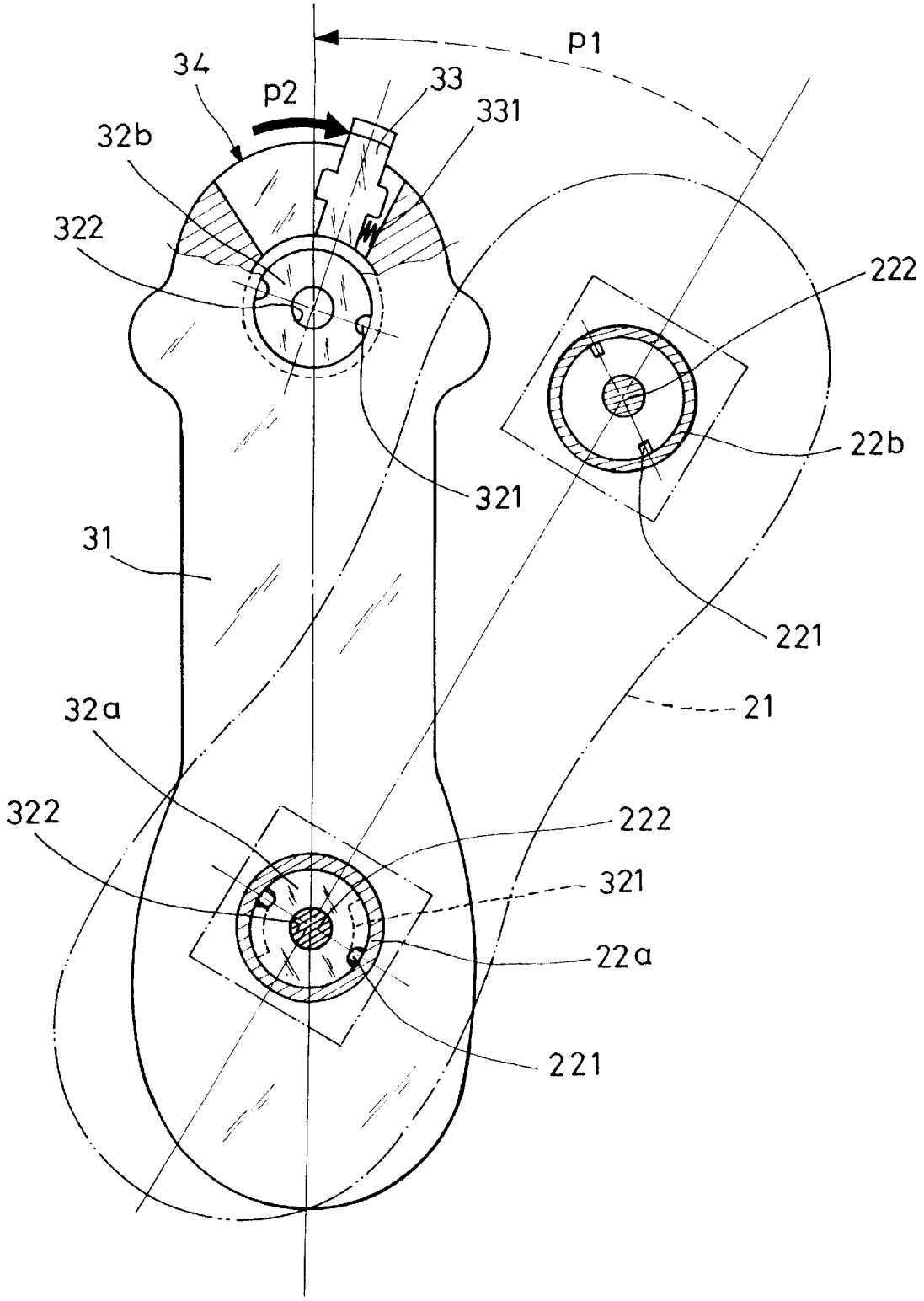
FIG. 7 is a schematic drawing in the direction 7—7 of FIG. 4, showing that the shoe are ready to be engaged with the skating device.
Figure 8:
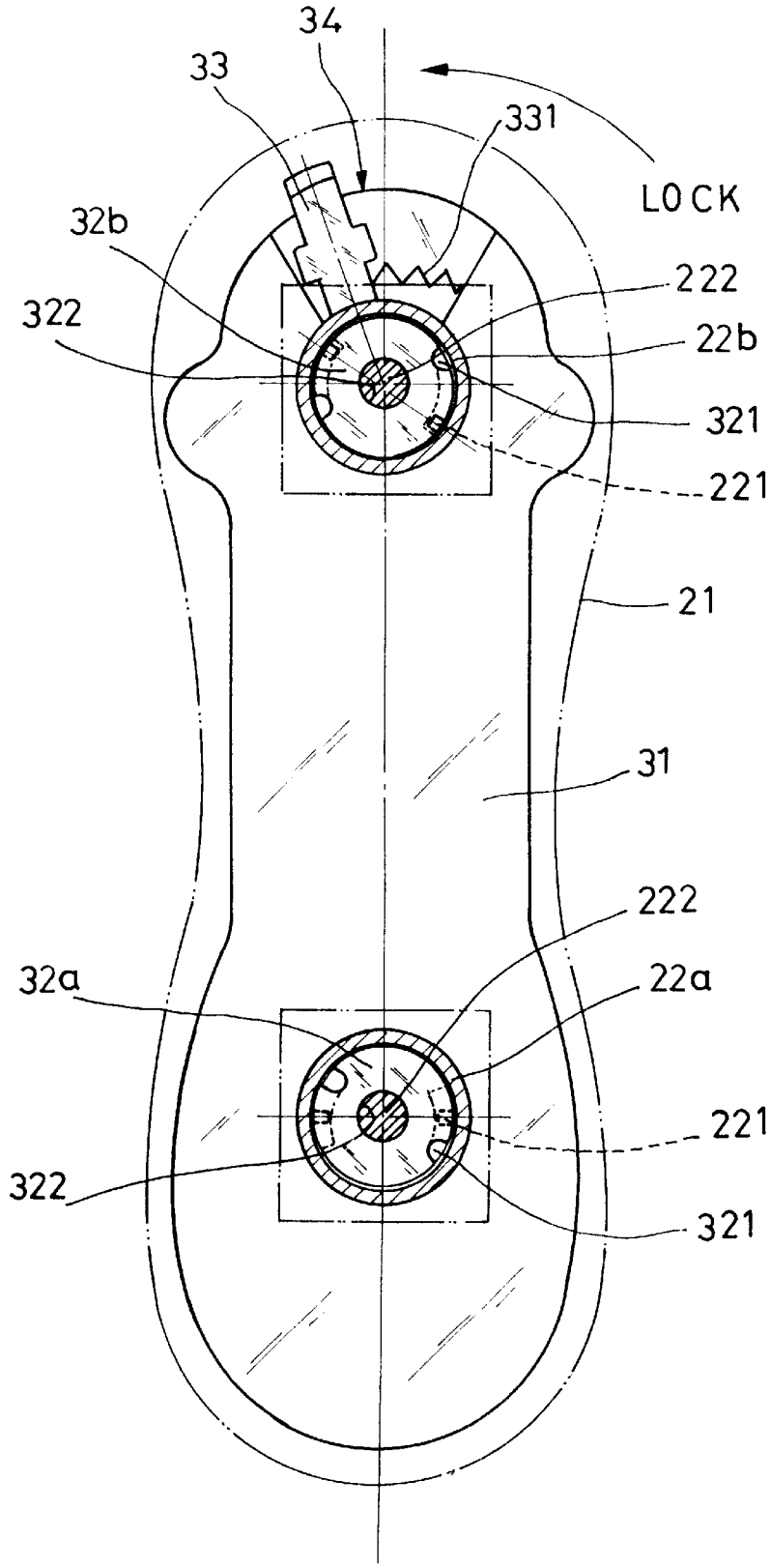
FIG. 8 is a schematic drawing in the direction 7–7 of FIG. 4, showing that the shoe is engaged with the skating device.
Figure 9:
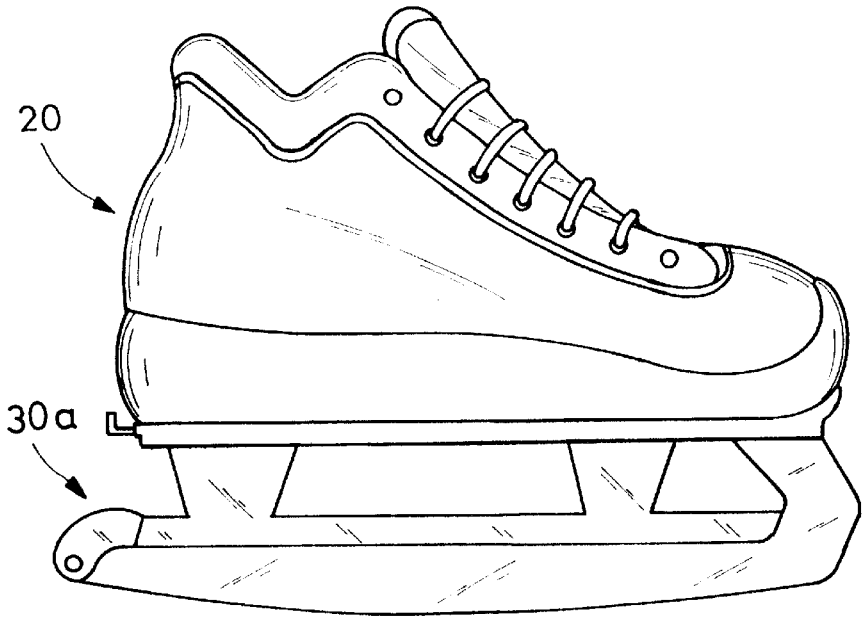
FIG. 9 is a side view of the present invention applied to an ice skate.
Figure 10:
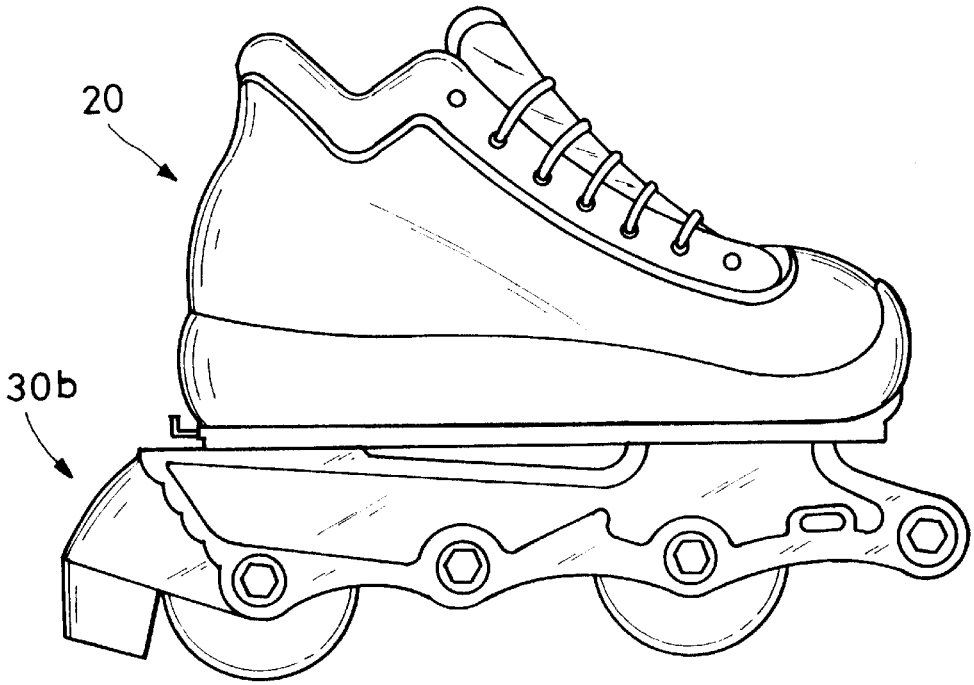
FIG. 10 is a side view of the present invention applied to an in-line skate.
Figure 11:
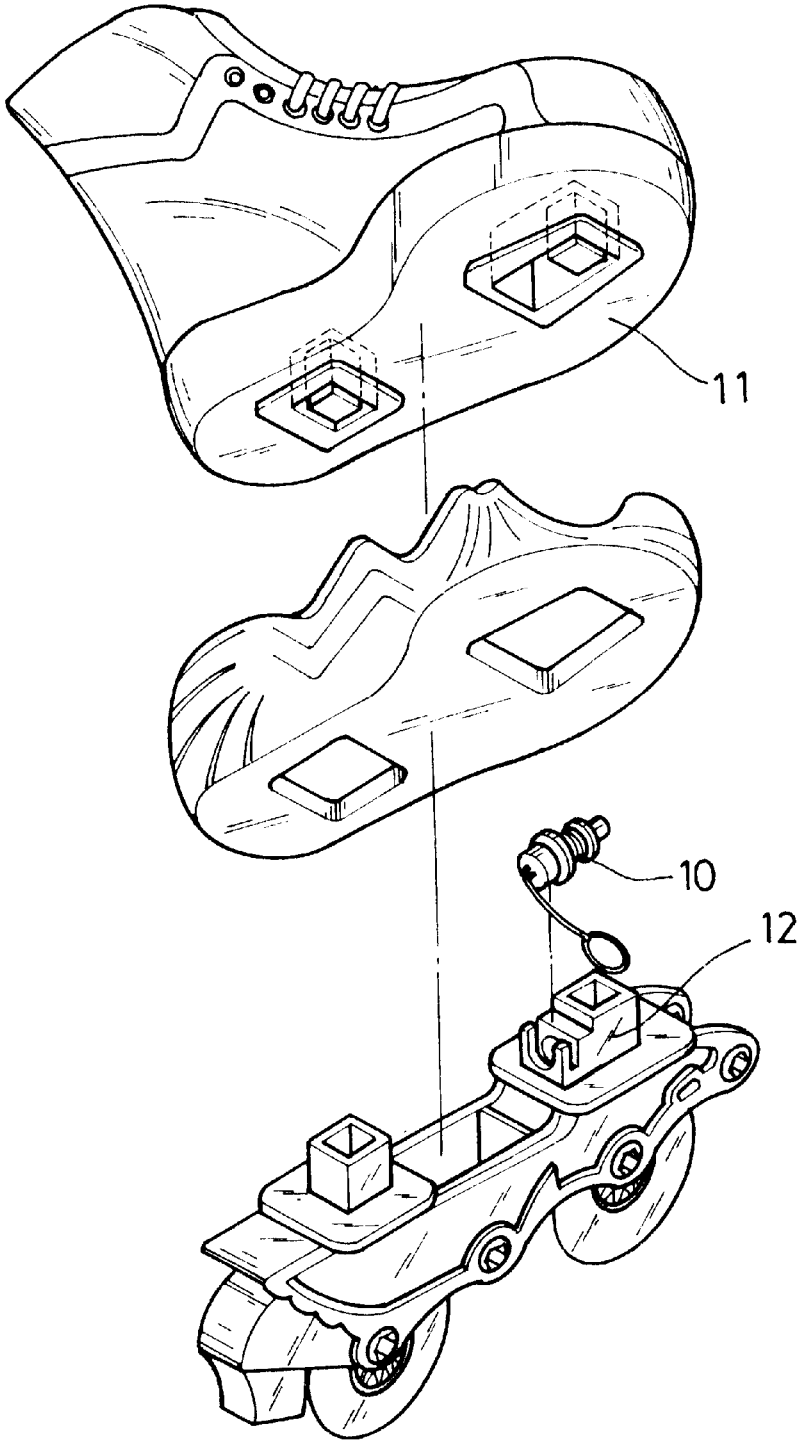
FIG.11 (PRIOR ART)
FIG. 11 is a perspective exploded view of a conventional in-line skate of the Taiwan Pat. No. 447319.
Figure 12:
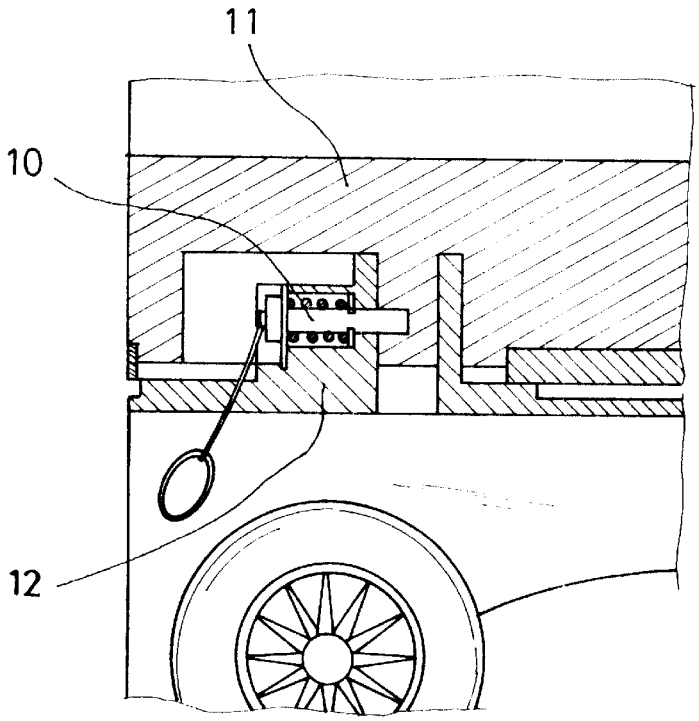
FIG.12 (PRIOR ART)
FIG. 12 is a schematic drawing of the arrangement of a safety pin of FIG. 11.
Figure 13:
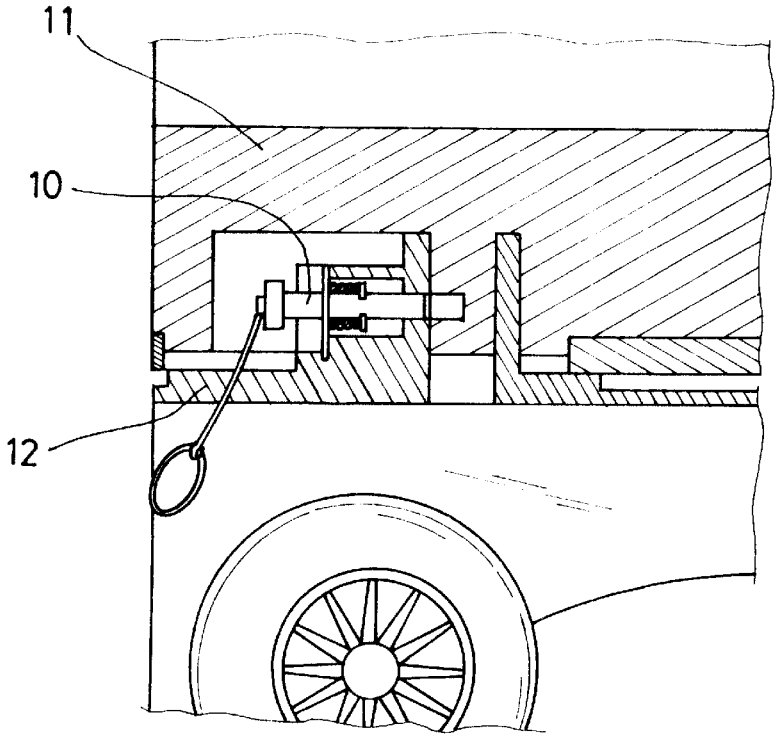
FIG.13 (PRIOR ART)
FIG. 13 is a schematic drawing of the safety pin of FIG. 11 which is pulled out.

Base upon the above, the assembly of the present invention, as shown in FIGS. 4 and 7, is performed in the way that the sole 21 of the shoe 20 is located at an angle of about 30° to the mounting plate 31 of the skating device 30. Thereafter, the female member 22*a* is correspondingly connected the male member 32*a* and is turned inwards at an angle in order that the projecting pin 221 is engaged into the horizontal part of the L-shaped guide slot 321. At this time, the sole 21 is pivoted on the female member 22*a* and the male member 32*a*. As illustrated by the arrow P1, the sole 21 is moved toward the top of the mounting plate 31 while the lever 33 is moved outwards in the direction shown by the arrow P2 so that the projecting pin 221 of the female member 22*b* can be aligned with the vertical opening of the L-shaped guide slot 321 of the male member 32*b* for inserting thereinto. Soon after that, the lever 33 is turned inwards to bring the male member 32*b* back to the position shown in FIG. 8. Now, both projecting pins 221 of the female members 22*a,* 22*b* are engaged into the horizontal part of the L-shaped guide slots 321 of the male members 32*a,* 32*b*. Thus, the present invention utilizes a turning angle and L-shaped engagement to ensure a stable connection between the shoe 20 and the skating device 30 during the exercise session so that it can be safely used.

Accordingly, the female members 22*a,* 22*b* and the male members 32*a,* 32*b* can be connected by means of the engagement of the projecting pins 221 into the L-shaped guide slots 321 so that the shoe 20 and the skating device 30 are secured together through a simple engagement operation. In addition to the roller skates, the present invention can also be applicable to the ice skates 30*a* and the in-line skates 30*b* whose shoes 20 are detachable from the skating devices so that it's convenient to assemble, stable and safe to use.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A skate apparatus comprising:

a shoe and a skating device detachably coupled by at least two engagement member sets, each of said engagement member sets including a female member fitted to a bottom sole of said shoe and a male member projecting upward through a round through hole in a mounting plate at a top of said skating device;

each said female member having an internal wall defining a socket having an opening downward, each said female member including at least one projecting pin extending radially from an internal wall thereof;

each said male member fitting into one said female member, each said male member having formed at an outer side thereof a substantially L-shaped guide slot corresponding to said projecting pin, said substantially L-shaped guide slot having a horizontal part retentively engaged by said projecting pin to releasably lock said male and female members of said engagement member set upon engagement thereof;

said male member of at least one engagement member set being angularly displaceable relative to said female member responsive to user manipulation of a lever extending therefrom, said lever being received in a groove formed at a bottom of said mounting plate to be displaceable relative to said mounting plate within stop limits defined by said groove, said male member being displaceably captured by a fixing plate coupled to the bottom of said mounting plate;

whereby said shoe is attachable to said skating device by sequentially engaging a first of said engagement member sets, said shoe being angularly displaced relative to said mounting plate of said skating device for locking said first engagement member set and said lever being thereafter displaced for locking the other of said engagement member sets.

2. A skate apparatus comprising:

a shoe and a skating device detachably coupled by at least two engagement member sets, each of said engagement member sets including a first member fitted to a bottom sole of said shoe and a second member extending from a mounting plate at a top of said skating device;

one of said first and second members of each said engagement member set including a female member having an internal wall defining a socket having an opening downward, each said female member including at least one projecting pin extending radially from an internal wall thereof;

the other of said first and second members of each said engagement member set including a male member coaxially engaging said female member, each said male member having formed at an outer side thereof a substantially L-shaped guide slot corresponding to said projecting pin, said substantially L-shaped guide slot being configured to engage and guide said projecting pin therealong for axial and angular displacement of said female member relative to said male member, said substantially L-shaped guide slot having a horizontal part retentively engaged by said projecting pin to releasably lock said male and female members of said engagement member set upon engagement thereof;

said male member of at least one engagement member set being angularly displaceable relative to said female member responsive to user manipulation of a lever extending transversely therefrom;

whereby said shoe is attachable to said skating device by sequentially engaging a first of said engagement member sets, said shoe being angularly displaced relative to said mounting plate of said skating device for locking said first engagement member set and said lever being thereafter displaced for locking the other of said engagement member sets.

3. The skate apparatus as recited in claim 2, wherein each said female member includes an axially extending vertical guide post, and each said male member has formed therein an axially extending guide hole for receiving said vertical guide post of one said female member.

4. The skate apparatus as recited in claim 2, wherein said mounting plate has formed therein a round through hole for passing a portion of said second member to project upward therethrough, said lever being displaceably disposed within a groove formed between said mounting plate and a fixing plate coupled to a bottom thereof.

5. The skate apparatus as recited in claim 2, wherein said lever is provided with a resilient element for biasing said male member to a locked state.

6. The skate apparatus as recited in claim 5, wherein said resilient element includes a compression spring.

7. The skate apparatus as recited in claim 5, wherein said resilient element includes a leaf spring.

* * * * *